US006722130B1

(12) United States Patent
Snekkenes et al.

(10) Patent No.: US 6,722,130 B1
(45) Date of Patent: Apr. 20, 2004

(54) METHOD OF PRODUCING PROCESS STEAM FROM A BLACK LIQUOR

(75) Inventors: Vidar Snekkenes, Karlstad (SE); Lennart Gustavsson, Karlstad (SE); Per Nystrom, Karlstad (SE)

(73) Assignee: Kvaerner Pulping AB, Karlstad (SE)

( * ) Notice: Subject to any disclaimer, the term of this patent is extended or adjusted under 35 U.S.C. 154(b) by 0 days.

(21) Appl. No.: 09/831,172

(22) PCT Filed: Nov. 9, 1998

(86) PCT No.: PCT/SE98/02014

§ 371 (c)(1),
(2), (4) Date: May 4, 2001

(87) PCT Pub. No.: WO00/28136

PCT Pub. Date: May 18, 2000

(51) Int. Cl.[7] ..... F01K 17/00
(52) U.S. Cl. ..... 60/648; 60/649; 60/670
(58) Field of Search ..... 60/648, 649, 670, 60/671

(56) References Cited

U.S. PATENT DOCUMENTS 4,401,510 A 8/1983 Olson et al.
4,925,527 A 5/1990 Ryham
5,380,402 A * 1/1995 Ryham et al. ..... 162/30.1
5,413,674 A * 5/1995 Ragi ..... 159/47.3
5,944,950 A * 8/1999 Olausson et al. ..... 159/47.3
6,306,252 B1 * 10/2001 Ryham ..... 162/47
6,346,166 B1 * 2/2002 Kettunen et al. ..... 162/14

FOREIGN PATENT DOCUMENTS

WO WO 96/32531 10/1996

* cited by examiner

*Primary Examiner*—Hoang Nguyen
(74) *Attorney, Agent, or Firm*—Rolf Fasth; Fasth Law Offices

(57) ABSTRACT

Method of producing a process steam from a first black liquor derived in connection with the production of paper pulp, wherein the first black liquor is treated to give a second black liquor of a higher concentration than the first black liquor as well as a liquid of low concentration, whereafter said process steam is produced from the low concentration liquid.

10 Claims, 1 Drawing Sheet

METHOD OF PRODUCING PROCESS STEAM FROM A BLACK LIQUOR

TECHNICAL FIELD

Figure 1:
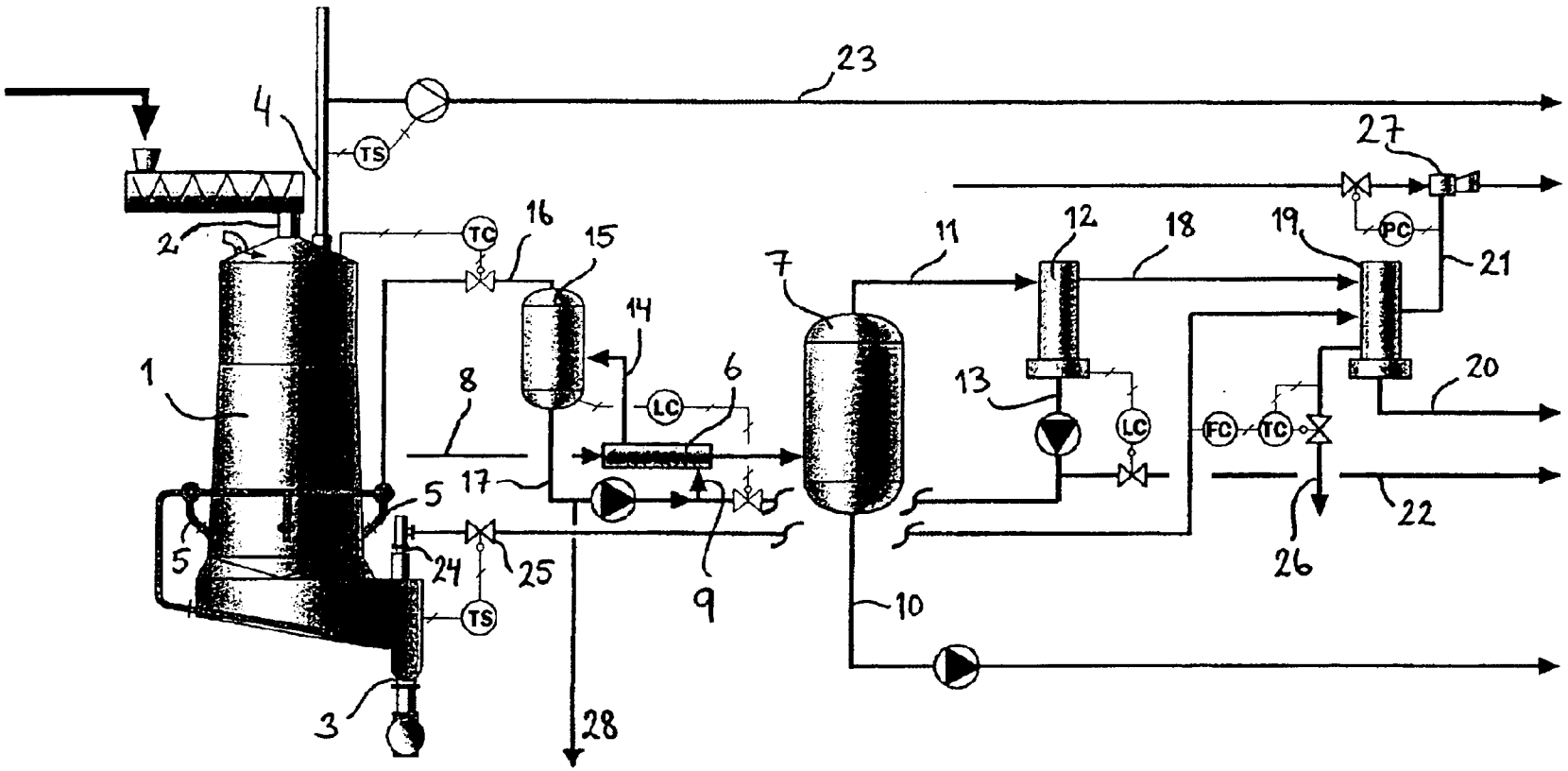

The invention relates to a method of producing process steam from a black liquor derived in connection with the production of paper pulp.

STATE OF THE ART

In the production of chemical paper pulp it is conventional to recover the cooking chemicals to be used again. This is normally done by evaporating a spent cooking liquor, in the case of kraft cooking a so called black liquor, and directing the concentrated spent cooking liquor to some type of recovery boiler or gasification system. Before this, at least some of the heat content of the black liquor can be, and usually is, used, for example by expansion evaporation, i.e. flashing, in one or more expansion evaporation units. From the expansion evaporation unit exits black liquor of a higher concentration than the concentration of the incoming black liquor, and steam which can be used at a desired location in the production of paper pulp. Such steam is conventionally used for example to pretreat the cellulose containing raw material, e.g. the chips, in order to heat it and to drive out gases which are captured in cavities inside the chips. The steam however contains a considerable amount of non-condensable gases, such as hydrogen sulphide, methyl mercaptan, dimethyl sulphide and dimethyl disulphide, and also for example methanol and turpentine. The mixture of these gases is liable to explosion, but as long as it is present together with steam there is no risk of explosion. However, when the steam, containing the just mentioned gases, is contacted with the cold chips, for example in a counter current manner in a chip bin, the steam condenses and the gases are accumulated at the top of the chip bin. In older systems, the gases have simply been let out into the air and have thus been diluted so that their concentration in the air has become lower than the lower explosion limit (LEL), whereby there has been no risk of explosion. Due to environmental restrictions, many pulp mills have however nowadays started to collect the gases in order to burn them at a concentration lower than the LEL. In the top of the chip bin for example, the concentration may however reach values above the LEL which has been known to cause explosion. Thus, there has arised a problem in the handling of the gases which are accumulated in the chip bin, or at any other location.

From SE-A-9703680-0, there is known a method of producing relatively clean steam with a relatively low content of non-condensable gases using heat from black liquor. The black liquor is, according to the method, not exposed to expansion evaporation, but the heat is instead used to indirectly heat a relatively clean liquid in a heat exchanger in order to vaporise it. The steam which is formed contains non or only small amounts of non-condensable gases and can be used to steam the chips without the risk of accumulation of explosive gases. There is also mentioned the possibility to introduce some black liquor into the heat exchanger to be vaporised, which is said to yield a steam which is not clean but which all the same has a lower concentration of non-condensable gases than steam from conventional expansion evaporation.

SHORT DESCRIPTION OF THE INVENTION

By the present invention, there is achieved a method of producing a process steam from black liquor, whereby the steam becomes essentially free from impurities such as non-condensable gases (e.g. hydrogen sulphide, methyl mercaptan, dimethyl sulphide and dimethyl disulphide) and whereby recovery of turpentine is improved. The process steam is preferably used to pretreat cellulose containing raw material in the production of paper pulp.

This is achieved, according to the invention, by treating a first black liquor to give a second black liquor of a higher concentration than said first black liquor as well as a liquid of low concentration, whereafter said process steam is produced from said low concentration liquid. It is to be understood that the "higher concentration" of the second black liquor refers primarily to its contents of organic compounds such as lignin, hemicelluloses etc, whereas the "low concentration" of the liquid of low concentration refers primarily to its contents of non-condensable gases and turpentine, although of course the concentration of organic compounds also is low in this liquid.

According to one aspect of the invention, said first black liquor is evaporated in a first evaporation step to give a second black liquor of a higher concentration as well as a first steam, which first steam comprises non-condensable gases and turpentine, whereafter said first steam, in a subsequent step, is partly condensed in a first condensing step to give a first condensate, which first condensate in its turn is evaporated in a second evaporation step to give said process steam.

According to another aspect of the invention, a remaining gas from said first condensing step is at least partly condensed in a second condensing step, which second condensing step is performed at a slight vacuum, preferably at 0.70–0.99 bar (abs) and more preferred at 0.80–0.95 bar (abs), to give a turpentine containing second condensate and a gas phase comprising non-condensable gases. The turpentine containing second heat is instead used to indirectly heat a relatively clean liquid in a heat exchanger in order to vaporise it. The steam which is formed contains non or only small amounts of non-condensable gases and can be used to steam the chips without the risk of accumulation of explosive gases. There is also mentioned the possibility to introduce some black liquor into the heat exchanger to be vaporised, which is said to yield a steam which is not clean but which all the same has a lower concentration of non-condensable gases than steam from conventional expansion evaporation.

SHORT DESCRIPTION OF THE INVENTION

By the present invention, there is achieved a method of producing a process steam from black liquor, whereby the steam becomes essentially free from impurities such as non-condensable gases (e.g. hydrogen sulphide, methyl mercaptan, dimethyl sulphide and dimethyl disulphide) and whereby recovery of turpentine is improved. The process steam is preferably used to pretreat cellulose containing raw material in the production of paper pulp.

This is achieved, according to the invention, by treating a first black liquor to give a second black liquor of a higher concentration than said first black liquor as well as a liquid of low concentration, whereafter said process steam is produced from said low concentration liquid. It is to be understood that the "higher concentration" of the second black liquor refers primarily to its contents of organic compounds such as lignin, hemicelluloses etc, whereas the "low concentration" of the liquid of low concentration refers primarily to its contents of non-condensable gases and turpentine, although of course the concentration of organic compounds also is low in this liquid.

According to one aspect of the invention, said first black liquor is evaporated in a first evaporation step to give a second black liquor of a higher concentration as well as a first steam, which first steam comprises non-condensable gases and turpentine, whereafter said first steam, in a subsequent step, is partly condensed in a first condensing step to give a first condensate, which first condensate in its turn is evaporated in a second evaporation step to give said process steam.

According to another aspect of the invention, a remaining gas from said first condensing step is at least partly condensed in a second condensing step, which second condensing step is performed at a slight vacuum, preferably at 0.70–0.99 bar (abs) and more preferred at 0.80–0.95 bar (abs), to give a turpentine containing second condensate and a gas phase comprising non-condensable gases. The turpentine containing second condensate is led to a turpentine decanter to be separated from the water. The gas phase is of low volume and high concentration (LVHC), which means that the concentration is above the upper explosion limit (UEL, limit normally at a concentration about 50–80%) and that the gas thus can be burned without risk of explosion.

It is a major advantage of the method according to the invention that heat from black liquor can be used in order to produce steam which is relatively free from turpentine and non-condensable gases. The black liquor is preferably expansion evaporated, as is conventional, but the flash steam is freed from the undesired gases before it is used in the process of paper pulp production, preferably by condensation and the reforming of steam from the condensate. An additional advantage is that turpentine recovery is improved by the method according to the invention. This also makes the method especially suited for softwood systems, due to softwood having a higher turpentine content than hardwood.

Additional aspects of the invention will be readily clear from the following detailed description and from the appending claims.

DETAILED DESCRIPTION OF THE INVENTION

With reference now to FIG. 1, detail number 1 symbolises a continuously operating chip bin, which of course may be of any other known or yet unknown configuration. The chips enter the chip bin at the top 2, via a screw feeder and exit the chip bin at the bottom side 3 in order to be further processed in a manner known per se, e.g. in a batch cooking system or a one or two vessel continuous cooking system for production of chemical pulp. At a level normally in the lower part of the chip bin, are situated a number of inlets 5 for steam, in the shown embodiment surrounding the circumference of the chip bin. The chips inside the bin 1 are heated by means of the steam which steam thus condenses. Any non-condensable gases or methanol present in the steam will exit the bin 1 at the top via the outlet 4. According to the invention, the gases which exit the bin via the outlet 4 are of high volume and low concentration (HVLC), well below, i.e. preferably below 25% of the lower explosion limit (LEL, limit normally at a concentration about 2%). The possibly existing contaminants mainly comprise methanol which can be led 23 to a scrubbing step (not shown), whereby the system according to the method may be used instead of expensive and complicated incineration of weak gases with a history of incidents. Optionally, depending on the amount of contaminating compounds and on the environmental demands, the gases in 4 or 23 can be let out directly into the environment. The chip bin 1 also presents a degassing outlet 24 in its lower part. The outlet 24 also includes a valve 25 which is controlled to be closed when the temperature gets below about 95° C. in order to prevent air from exiting through the outlet.

Turning now to the production of the process steam to be introduced in the chip bin, hot spent cooking liquor, so called black liquor 8 with a temperature of typically about 150–160° C., is extracted from the cooking process (not shown) and a certain amount of its heat content is used to heat a liquid 9 of a lower temperature in an indirect heat exchanger 6. In the heat exchanger the liquid 9 is preferably heated to yield a temperature in the leaving liquid 14 which is about 10° C. below the temperature of the black liquor 8. From the outlet of the heat exchanger, the black liquor, which holds a pressure of about 10–20 bar, depending on production, and a temperature which is preferably at least 140° C., is led to an expansion evaporation unit 7 where its pressure is relieved to just above atmospheric pressure, preferably to about 1.0–2 bar (abs) and even more preferred to about 1.1–1.5 bar (abs). Through this expansion evaporation step the black liquor 10, which exits the unit at the bottom, achieves a higher concentration than the black liquor which is incoming to the evaporation unit 7. The black liquor 10 is preferably led to further evaporation in order to subsequently be treated for chemicals recovery. Steam 11, comprising non-condensable gases, turpentine and methanol, exits the evaporation unit 7 at the top and is led to a first condensing step 12 in a first condenser. The first condenser 12 operates to give a first condensate 13 with a temperature close to 100° C., preferably 90–99° C. and even more preferred 95–98° C. By condensing only, no subcooling, turpentine is effectively separated from water. It has been shown that a condensate slightly below 100° C. contains little or no turpentine. The first condensate 13 is thus essentially free from turpentine and non-condensable gases and constitutes at least a part of the liquid 9 to be heated in said heat exchanger 6. After being heated the first condensate is led 14 to a second expansion evaporation step in a second expansion evaporation unit 15 where it is flashed to produce a relatively clean process steam 16 which may be used in any desired location of the pulp mill, preferably for the steaming of the chips. In expansion evaporation unit 15 the pressure release is as large as possible, while maintaining a pressure in the steam 16 of about 1.1–1.5 bar (abs), preferably 1.3–1.5 bar (abs), to create a driving force for the introduction of the steam in the desired location of the pulp mill. The temperature of the steam 16 will correspond to its pressure. A remaining liquid 17 from the second expansion evaporation step may be joined with said first condensate 13 upstream the indirect heating in the heat exchanger 6 or if its concentration of turpentine or other undesired compounds is undesiredly high, it may be joined (not shown) with the black liquor 8 before it is expansion evaporated in the unit 7. the temperature gets below about 95° C. in order to prevent air from exiting through the outlet.

Turning now to the production of the process steam to be introduced in the chip bin, hot spent cooking liquor, so called black liquor 8 with a temperature of typically about 150–160° C., is extracted from the cooking process (not shown) and a certain amount of its heat content is used to heat a liquid 9 of a lower temperature in an indirect heat exchanger 6. In the heat exchanger the liquid 9 is preferably heated to yield a temperature in the leaving liquid 14 which is about 10° C. below the temperature of the black liquor 8. From the outlet of the heat exchanger, the black liquor, which holds a pressure of about 10–20 bar, depending on production, and a temperature which is preferably at least 140° C., is led to an expansion evaporation unit 7 where its pressure is relieved to just above atmospheric pressure, preferably to about 1.0–2 bar (abs) and even more preferred to about 1.1–1.5 bar (abs). Through this expansion evaporation step the black liquor 10, which exits the unit at the bottom, achieves a higher concentration than the black liquor which is incoming to the evaporation unit 7. The black liquor 10 is preferably led to further evaporation in order to subsequently be treated for chemicals recovery. Steam 11, comprising non-condensable gases, turpentine and methanol, exits the evaporation unit 7 at the top and is led to a first condensing step 12 in a first condenser. The first condenser 12 operates to give a first condensate 13 with a temperature close to 100° C., preferably 90–99° C. and even more preferred 95–98° C. By condensing only, no subcooling, turpentine is effectively separated from water. It has been shown that a condensate slightly below 100° C. contains little or no turpentine. The first condensate 13 is thus essentially free from turpentine and non-condensable gases and constitutes at least a part of the liquid 9 to be heated in said heat exchanger 6. After being heated the first condensate is led 14 to a second expansion evaporation step in a second expansion evaporation unit 15 where it is flashed to produce a relatively clean process steam 16 which may be used in any desired location of the pulp mill, preferably for the steaming of the chips. In expansion evaporation unit 15 the pressure release is as large as possible, while maintaining a pressure in the steam 16 of about 1.1–1.5 bar (abs), preferably 1.3–1.5 bar (abs), to create a driving force for the introduction of the steam in the desired location of the pulp mill. The temperature of the steam 16 will correspond to its pressure. A remaining liquid 17 from the second expansion evaporation step may be joined with said first condensate 13 upstream the indirect heating in the heat exchanger 6 or if its concentration of turpentine or other undesired compounds is undesiredly high, it may be joined (not shown) with the black liquor 8 before it is expansion evaporated in the unit 7. The gases 18 which are not condensed in the first condensing step 12 are led to a second condensing step 19 in a second condensor. This second condensing step 19 is performed at a slight vacuum, preferably at 0.7–0.99 bar (abs) and more preferred at 0.8–0.95 bar (abs), to give a turpentine containing second condensate 20 and a gas phase 21 comprising non-condensable gases. The second condensate 20 is led to a turpentine decanter to separate it from water, whereafter the turpentine can be sold and used as conventional. The gas phase 21 from the second condensing step is of low volume and high concentration (LVHC). Moreover it has a concentration above the upper explosion limit (UEL) and can thus be destroyed by burning. A steam ejector 27 connected to the conduit for the gas phase 21 is used to create the vacuum in the second condenser 19. Alternatively, a fan or other corresponding equipment may be used. To the second condenser 19 there may also be led the gases from the degassing outlet 24 of the chip bin. As have already been mentioned, precautions are made (valve 25) to prevent air from accompanying these gases, which air otherwise might dilute the gas phase 21 from the second condensing step so that the concentration falls below the upper explosion limit. Also shown is an outlet 26 for cooling water from the second condenser 19 (the corresponding inlet not being shown).

The system according to the method also includes to possibility to extract condensate to be used for other purposes in the mill. Condensate may be extracted via line 22 from the first condenser 12 and/or via line 28 from the second expansion evaporation unit 15. Extraction via line 28 is preferred since accumulation of fibres and inorganic compounds in the evaporation unit 15 thereby is avoided.

The method according to the invention is not limited to the above mentioned embodiment but may be varied within the scope of the claims. It is for example to be understood that a liquid with a lower concentration than the first black liquor may be formed by other means than expansion evaporation followed by condensing. Also, it is to be understood that the produced process steam may be used for other purposes in the production of paper pulp. Furthermore, the system as shown in FIG. 1 may be operated without the heat exchanger, whereby the first condensate is led directly to the second expansion evaporation step and the first black liquor is led directly to the first expansion evaporation step.

EXAMPLE

In the method according to the invention essentially all turpentine and non-condensable gases are separated from the process steam which is produced. To determine to which extent methanol is separated by the method, calculations were made. The results of these calculations are presented in Table 1 in kg per ton air dry pulp.

As can be seen, with a given methanol content of 12 kg ptp in the black liquor from extraction, the process steam 16 which is produced will contain only 2.5 kg ptp of methanol. Thus, more than 75% of the methanol in the black liquor is separated in the method according to the invention. This should be compared with the amount of methanol which would follow the process steam if it, as is conventional, would be derived by direct expansion evaporation of the black liquor, namely 4 kg ptp (i.e. methanol in line 8 minus methanol in line 10). Thus the methanol content in the process steam is lowered with more than 35% in comparison with process steam from a conventional system.

TABLE 1

| Line | Name | Flow (kg ptp) | Temp. (° C.) | MeOH (kg ptp) |
|---|---|---|---|---|
| 8 | Black liquor from extraction | 11550 | 165 | 12 |
| | Black liquor to 7 | 11550 | 145 | 12 |
| 11 | Steam from 7 | 750 | 107 | 4 |
| 10 | Black liquor from 7 | 10800 | 107 | 8 |
| 18 | Gas from 12 to 19 | 50 | 100 | 1.4 |
| 13 | Condensate from 12 | 700 | 100 | 2.6 |
| 21 | Non-condensable gases | 50 | 60 | 0.4 |
| 20 | Turpentine condensate | 250 | 60 | 2 |
| 9 | Condensate to heat exchanger 6 | 15700 | 106.7 | 5.8 |
| | Circulation to heat exchanger 6 | 15000 | 107 | 8 |
| 28 | Bleed off | 50 | 107 | 0.1 |
| 14 | Condensate from heat exch. 6 | 15700 | 129 | 10.6 |
| 16 | Process steam | 650 | 107 | 2.5 |
| 17 | Condensate from 15 | 15050 | 107 | 8.1 |
| | Steam to 27 | 250 | 100 | 1 |

What is claimed is:

1. A method of producing a process steam, comprising:

(a) providing a first black liquor derived in connection with a production of paper pulp;

(b) evaporating the first black liquor in a first evaporation step to produce a second black liquor and a first steam, the second black liquor having a second concentration being greater than a first concentration of the first black liquor, the first steam comprising non-condensable gases and turpentine;

(c) partly condensing the first steam in a first condensing step to produce a low concentration first condensate;

(d) indirectly heating the first condensate by the first black liquor; and (e) evaporating the heated first condensate in a second evaporation step to produce a process steam, the process steam being substantially free from non-condensable gases.

2. The method according to claim 1, wherein the method further comprises the step of performing the first evaporation step as an expansion evaporation step.

3. The method according to claim 1, wherein the first condensation step further comprises providing the first condensate with a temperature of about 100° C.

4. The method according to claim 1, wherein the first condensation step further comprises providing the first condensate with a temperature of 90–99° C.

5. The method according to claim 1, wherein the first condensation step further comprises providing the first condensate with a temperature of 95–98° C.

6. The method according to claim 1, wherein the method further comprises the step of performing the second evaporation step as an expansion evaporation step.

7. The method according to claim 1, wherein the method further comprises recycling a recyclable liquid from the second evaporation step by joining the recyclable liquid with the first condensate prior to the step of indirectly heating the first condensate.

8. The method according to claim 1, wherein the method further comprises at least partly condensing a remaining gas from the first condensing step in a second condensing step and the second condensing step being performed at a vacuum pressure of about 0.7–0.99 bar to produce a turpentine containing a second condensate and a gas phase, the gas phase comprising non-condensable gases.

9. The method according to claim 8, wherein the method comprises condensing the remaining gas at a vacuum pressure of about 0.8–0.95 bar.

10. The method according to claim 1, wherein the method further comprises pretreating a cellulose containing raw material in the process steam.

* * * * *